US010376910B2

(12) United States Patent
Okude et al.

(10) Patent No.: US 10,376,910 B2
(45) Date of Patent: Aug. 13, 2019

(54) REFILLABLE CONTAINER

(71) Applicant: NIPPON PAPER INDUSTRIES CO., LTD, Tokyo (JP)

(72) Inventors: Hideki Okude, Tokyo (JP); Takaharu Noda, Tokyo (JP)

(73) Assignee: NIPPON PAPER INDUSTRIES CO., LTD, Tokyo (JP)

( * ) Notice: Subject to any disclaimer, the term of this patent is extended or adjusted under 35 U.S.C. 154(b) by 0 days.

(21) Appl. No.: 16/060,244

(22) PCT Filed: Jul. 12, 2016

(86) PCT No.: PCT/JP2016/070499
§ 371 (c)(1),
(2) Date: Jun. 7, 2018

(87) PCT Pub. No.: WO2017/098745
PCT Pub. Date: Jun. 15, 2017

(65) Prior Publication Data

US 2018/0361412 A1 Dec. 20, 2018

(30) Foreign Application Priority Data

Dec. 9, 2015 (JP) ..... 2015-240399

(51) Int. Cl.
*B08B 11/00* (2006.01)
*B65D 83/00* (2006.01)
*B05B 11/00* (2006.01)

(52) U.S. Cl.
CPC ..... *B05B 11/3045* (2013.01); *B05B 11/0008* (2013.01); *B05B 11/0038* (2018.08);
(Continued)

(58) Field of Classification Search
CPC ..... B05B 11/3045; B05B 11/0038; B05B 11/0008; B05B 11/0054; B65D 83/00; B65D 83/0072
(Continued)

(56) References Cited

U.S. PATENT DOCUMENTS 4,907,722 A * 3/1990 Ueda ..... B67B 7/28 220/277
5,421,485 A * 6/1995 Furuta ..... B05B 11/00412 222/95
(Continued)

FOREIGN PATENT DOCUMENTS

JP 7-45088 12/1995
JP 8-40476 2/1996
(Continued)

OTHER PUBLICATIONS

JP 2009-269651—English Translation, machine generated Jan. 2019 (Year: 2009).*
(Continued)

*Primary Examiner* — Benjamin R Shaw
(74) *Attorney, Agent, or Firm* — Wenderoth, Lind & Ponack, L.L.P.

(57) ABSTRACT

A refillable container including: an outer container having an opening formed on top thereof; a cover configured to close the opening of the outer container; an inner container configured to store liquid and accommodated in the outer container; and a dispense pump provided on the cover and configured to pump the liquid content in the inner container and dispense the liquid content outside of the refillable container under a state in which the suction tube is stuck into a suction port of the inner container. The suction tube of the pump is inserted into the inner container when the opening of the outer container is closed by a cover. The cover includes a tubular wall portion fitted to an outer periphery of
(Continued)

the outer container, and a distal end of the suction tube is positioned within an open end of the tubular wall portion.

5 Claims, 6 Drawing Sheets

(52) U.S. Cl.
CPC ..... *B05B 11/0054* (2013.01); *B65D 83/00* (2013.01); *B65D 83/0072* (2013.01)

(58) Field of Classification Search
USPC ..... 222/383.1
See application file for complete search history.

(56) References Cited

U.S. PATENT DOCUMENTS

2005/0284894 A1* 12/2005 Hore ..... A47G 23/0258 222/383.1
2011/0220682 A1* 9/2011 Lim ..... B05B 11/3023 222/183
2014/0014690 A1* 1/2014 Baron ..... B05B 11/0037 222/183

FOREIGN PATENT DOCUMENTS

| | | |
|---|---|---|
| JP | 2003-252338 | 9/2003 |
| JP | 2009-269651 | 11/2009 |
| WO | 2015/178913 | 11/2015 |

OTHER PUBLICATIONS

JP 07-04588—English Translation, machine generated Jan. 2019 (Year: 1995).*
International Search Report dated Sep. 20, 2016 in International (PCT) Application No. PCT/JP2016/070499.

* cited by examiner

REFILLABLE CONTAINER

TECHNICAL FIELD

The present invention relates to a refillable container capable of being refilled with a liquid content.

BACKGROUND ART

Hitherto, as a refillable container capable of being refilled with a liquid content, there has been known a refillable container including: an outer container having an opening formed on top thereof; a cover configured to close the opening of the outer container; an inner container configured to store a liquid content therein, and accommodated in the outer container so as to be replaceable when the liquid content is used up, the inner container having a suction port formed on top thereof; and a dispense pump, which includes a suction tube, and is provided on the cover and configured to pump up the liquid content and dispense the liquid content to an outside of the refillable container under a state in which the suction tube is inserted into the suction port of the inner container accommodated in the outer container. When the opening of the outer container is closed by the cover, the suction tube of the dispense pump is inserted into the suction port of the inner container (for example, see Patent Literature 1).

The refillable container as described in Patent Literature 1 is refilled in the following manner. Specifically, when the liquid content in the inner container is used up, the cover is disengaged from the outer container, and the suction tube of the dispense pump is pulled out of the inner container accommodated in the outer container. Then, the inner container accommodated in the outer container is taken out of the outer container, and the taken-out inner container is replaced with a new inner container.

CITATION LIST

Patent Literature

[PTL 1] JP 2003-252338 A

SUMMARY OF INVENTION

Technical Problem

However, in the refillable container as described in Patent Literature 1, when the cover is disengaged from the outer container, the suction tube of the dispense pump provided on the cover is longer than a tubular wall portion of the cover, and thus protrudes outwardly from a lower end of the cover. Accordingly, when the cover is disengaged from the outer container and then put on a floor or the like, a distal end of the suction tube of the dispense pump is brought into contact with the floor or the like. As a result, the suction tube becomes unhygienic, and there is a problem in that the liquid content adhering to the distal end of the suction tube soils the floor or the like.

Further, it has been known that when the distal end of the suction tube is stuck and inserted into the suction port of the inner container, in general, a distal end portion of the suction tube is obliquely cut into a pointed shape in order to easily stick the suction tube into the suction port. However, in a case in which the suction tube of the dispense pump protrudes outwardly from the lower end of the cover, when the suction tube is put on the floor or the like, the distal end of the suction tube may be damaged so that sticking performance cannot be secured. Further, there is a problem in that the pointed distal end may damage a hand of a user.

It is an object of the present invention to provide a refillable container that enables refilling work of a liquid content to be easily and safely performed through replacement of an inner container.

Solution to Problem

In order to achieve the above-mentioned object, according to the invention as described in Item 1, there is provided a refillable container, including: an outer container, which has an opening formed on top thereof, and is made of plastic; a cover, which is configured to close the opening of the outer container, and is made of plastic; an inner container, which is made of paper, configured to store a liquid content therein, and accommodated in the outer container so as to be replaceable when the liquid content is used up, the inner container having a hole formed in an upper surface thereof, and having a suction port formed by sealing the hole with a tearable film; and a dispense pump, which includes a suction tube, and is provided on the cover and configured to pump up the liquid content and dispense the liquid content to an outside of the refillable container under a state in which the suction tube is stuck into the suction port of the inner container accommodated in the outer container, the suction tube of the dispense pump being inserted into the suction port of the inner container, when the opening of the outer container is closed by the cover, wherein the cover includes a tubular wall portion to be fitted to an outer periphery of the outer container, and wherein the suction tube of the dispense pump has such a length that a distal end of the suction tube is positioned within an open end of the tubular wall portion.

According to the invention as described in Item 2, in the invention as described in Item 1, the suction tube of the dispense pump has such a length that the distal end of the suction tube is positioned at a vicinity of a bottom of the inner container when the opening of the outer container is closed by the cover.

According to the invention as described in Item 3, in the invention as described in Item 1 or 2, the suction tube of the dispense pump has a diameter smaller than a diameter of the hole that forms the suction port of the inner container, wherein the suction tube includes a collar portion having a wedge shape and a diameter equal to or slightly larger than the diameter of the hole, wherein, when the opening of the outer container is closed by the cover, along with downward movement of the suction tube of the dispense pump, the collar portion is brought into abutment against the hole, and is elastically deformed so as to enter the inner container, and wherein, when the cover is disengaged from the outer container, along with upward movement of the suction tube of the dispense pump, the collar portion is caught by the hole, thereby being pulled up together with the inner container.

According to the invention as described in Item 4, in the invention as described in any one of Items 1 to 3, one of the cover and the outer container has one of a convex stripe and a concave stripe, which are formed along a circumferential direction on one of an inner peripheral surface of the tubular wall portion of the cover and an outer peripheral surface of the outer container, and are engaged in a disengageable manner with each other when the opening of the outer container is closed by the cover.

According to the invention as described in Item 5, in the invention as described in any one of Items 1 to 4, the suction port of the upper surface of the inner container is formed at a center of the upper surface of the inner container, and wherein the dispense pump provided on the cover is provided at a center of a top plate portion of the cover.

Advantageous Effects of Invention

The refillable container as described in Item 1 includes: the outer container, which has the opening formed on top thereof and is made of plastic; the cover, which is configured to close the opening of the outer container and is made of plastic; the inner container, which is made of paper, configured to store the liquid content therein, and accommodated in the outer container so as to be replaceable when the liquid content is used up, the inner container having the hole formed in the upper surface thereof, and having the suction port formed by sealing the hole with the tearable film; and the dispense pump, which includes the suction tube, and is provided on the cover and configured to pump up the liquid content and dispense the liquid content to the outside of the refillable container under the state in which the suction tube is stuck into the suction port of the inner container accommodated in the outer container, the suction tube of the dispense pump being inserted into the suction port of the inner container when the opening of the outer container is closed by the cover, in which the cover includes the tubular wall portion to be fitted to the outer periphery of the outer container, and in which the suction tube of the dispense pump has such a length that the distal end of the suction tube is positioned within the open end of the tubular wall portion. With this configuration, when the cover is disengaged from the outer container, the suction tube of the dispense pump provided on the cover remains within the tubular wall portion of the cover, and thus does not protrude outwardly from a lower end of the cover, that is, the open end of the tubular wall portion. When the cover disengaged from the outer container is put on a floor or the like under a state in which the open end of the tubular wall portion is directed downward, the distal end of the suction tube of the dispense pump is prevented from being brought into contact with the floor or the like. Thus, hygiene can be secured, and the liquid content adhering to the distal end of the suction tube can be prevented from soiling the floor or the like.

Further, even in a case where a distal end portion of the suction tube of the dispense pump is obliquely cut so that the distal end has a pointed shape, owing to the configuration in which the suction tube of the dispense pump remains within the tubular wall portion of the cover and thus does not protrude outwardly from the lower end of the cover, that is, the open end of the tubular wall portion, even when the cover disengaged from the outer container is put on the floor or the like, there is no risk of damaging the distal end of the suction tube of the dispense pump. Thus, sticking performance can be ensured, and there may be prevented damage to a hand of a user with the pointed distal end.

According to the refillable container as described in Item 2, in the refillable container as described in Item 1, the suction tube of the dispense pump has such a length that the distal end of the suction tube is positioned at the vicinity of the bottom of the inner container when the opening of the outer container is closed by the cover. Thus, the dispense pump can pump up almost all the liquid content stored in the inner container. As a result, an amount of unused liquid content can be reduced.

According to the refillable container as described in Item 3, in the refillable container as described in Item 1 or 2, the suction tube of the dispense pump, which is described in has the diameter smaller than the diameter of the hole that forms the suction port of the inner container. Further, the suction tube includes the collar portion having the wedge shape and the diameter equal to or slightly larger than the diameter of the hole. When the opening of the outer container is closed by the cover, along with downward movement of the suction tube of the dispense pump, the collar portion is brought into abutment against the hole, and is elastically deformed to enter the inner container. When the cover is disengaged from the outer container, along with upward movement of the suction tube of the dispense pump, the collar portion is caught in the hole, and thus is pulled up together with the inner container. With this configuration, when the cover is disengaged from the outer container in order to replace the inner container in which the liquid content is used up, the wedge-shaped collar portion, which is provided on the suction tube of the dispense pump moved upward together with the cover, is caught in the hole forming the suction port of the inner container, and thus is pulled up together with the inner container. Thus, the inner container can be easily taken out of the outer container.

According to the refillable container as described in Item 4, in the refillable container as described in any one of Items 1 to 3, one of the cover and the outer container has one of a convex stripe and a concave stripe, which are formed along a circumferential direction on one of an inner peripheral surface of the tubular wall portion of the cover and an outer peripheral surface of the outer container, and are engaged in a disengageable manner with each other when the opening of the outer container is closed by the cover. With this configuration, there may be prevented an unintentional disengagement of the cover from the outer container, and entry of waterdrops into the outer container can be suppressed.

According to the refillable container described in Item 5, in the refillable container as described in any one of Items 1 to 4, the suction port of the upper surface of the inner container is formed at the center of the upper surface of the inner container. Further, the dispense pump provided on the cover is provided at the center of the top plate portion of the cover. With this configuration, when the tubular wall portion of the cover is fitted to the outer periphery of the outer container, the suction tube of the dispense pump provided on the cover is regulated so as to be positioned above the suction port formed in the upper surface of the inner container accommodated in the outer container. When the cover fitted to the outer periphery of the outer container is pushed forward along the outer periphery of the outer container, the distal end of the suction tube of the dispense pump provided on the cover is automatically guided and stuck into the suction port formed in the upper surface of the inner container accommodated in the outer container. Thus, the suction tube of the dispense pump can be easily and reliably inserted into the suction port of the inner container.

DESCRIPTION OF EMBODIMENTS

Now, an example of a refillable container according to one embodiment of the present invention is described in detail with reference to the drawings.

Figure 1:
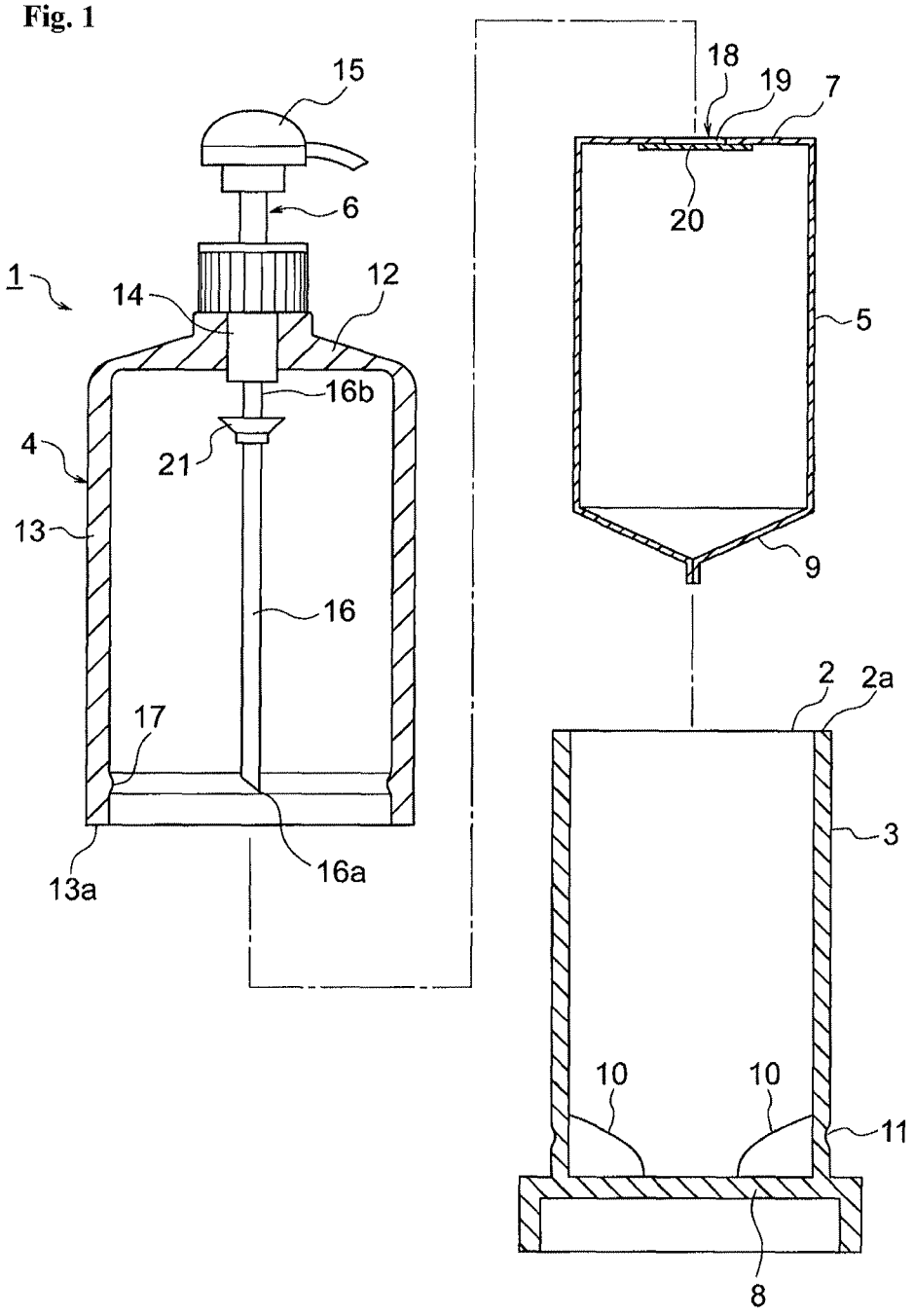
FIG. 1 is an exploded sectional view for illustrating one example of a refillable container according to an embodiment of the present invention.
Figure 2:
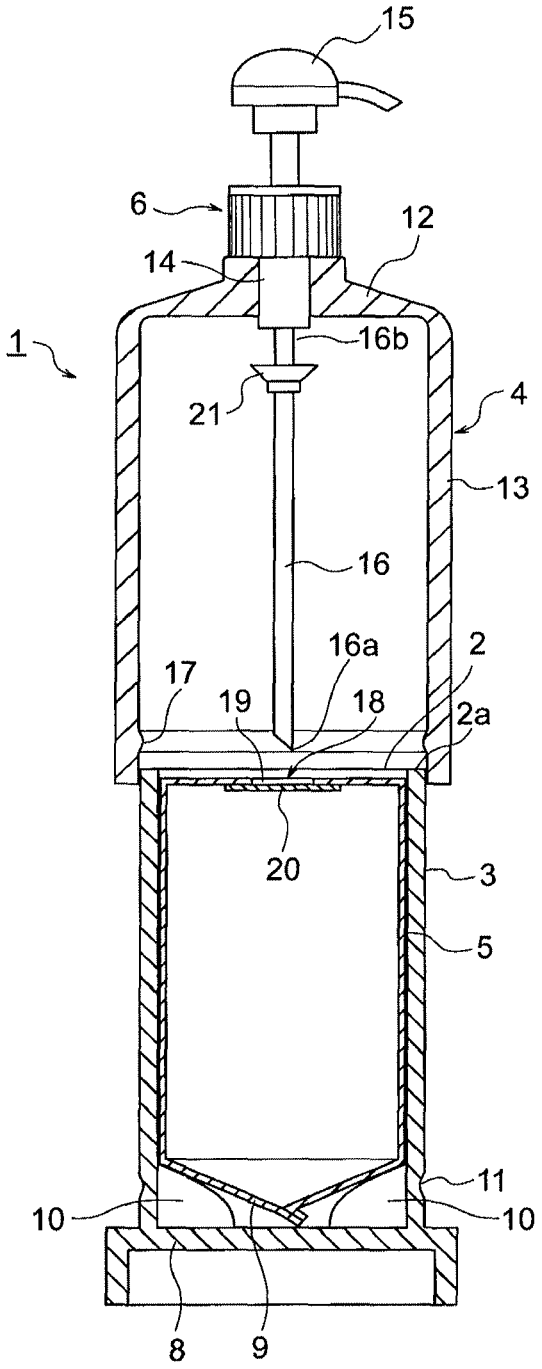
FIG. 2 is a sectional view for illustrating a step of accommodating an inner container in an outer container of the refillable container illustrated in FIG. 1.
Figure 3:
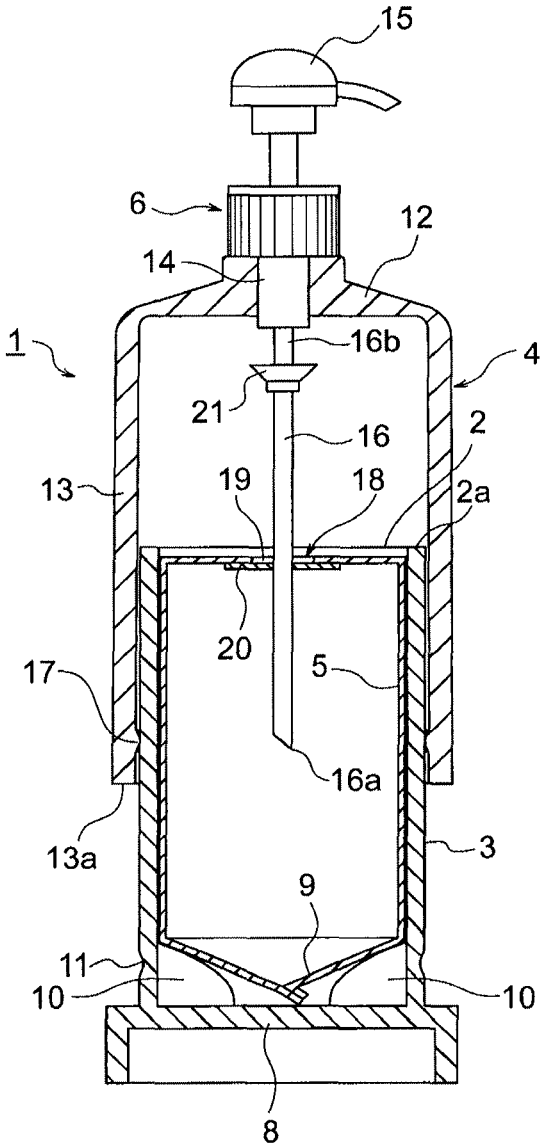
FIG. 3 is a sectional view for illustrating a step of accommodating the inner container in the outer container of the refillable container illustrated in FIG. 1.
Figure 4:
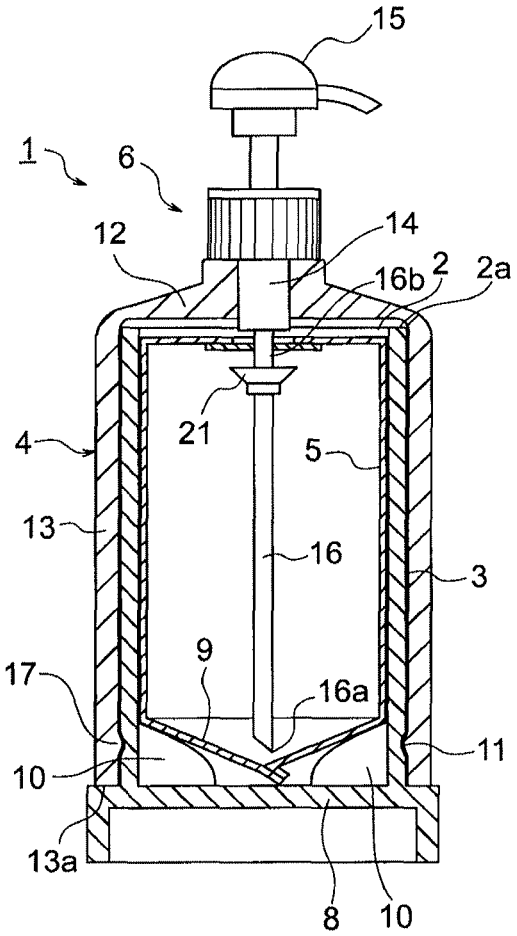
FIG. 4 is a sectional view for illustrating a complete state of accommodation of the inner container in the outer container of the refillable container illustrated in FIG. 1.
Figure 5:
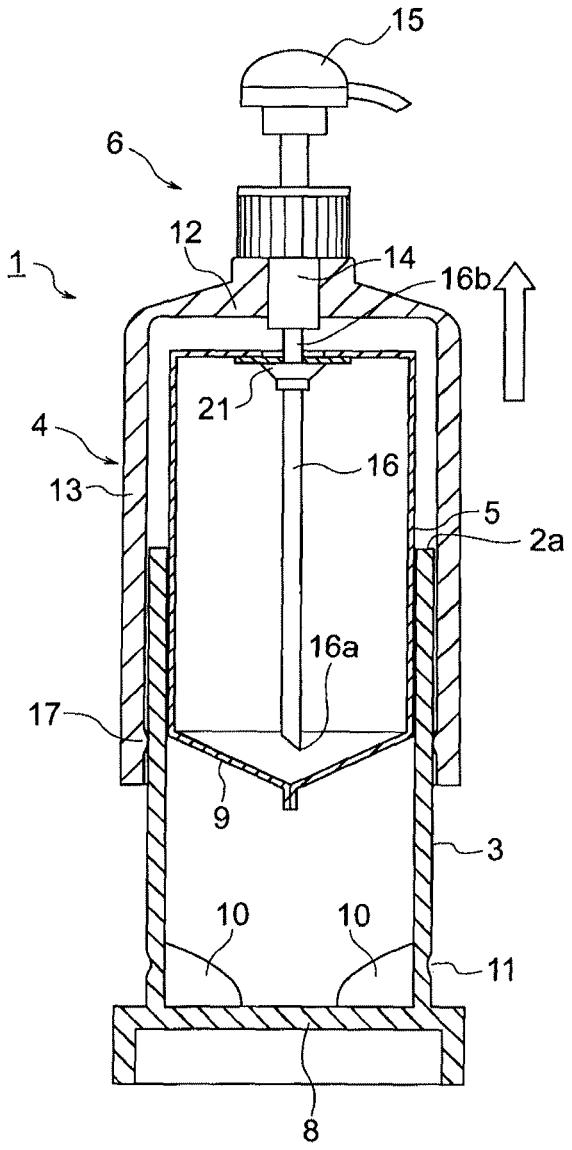
FIG. 5 is a sectional view for illustrating a step of taking the inner container out of the outer container of the refillable container illustrated in FIG. 1.
Figure 6:
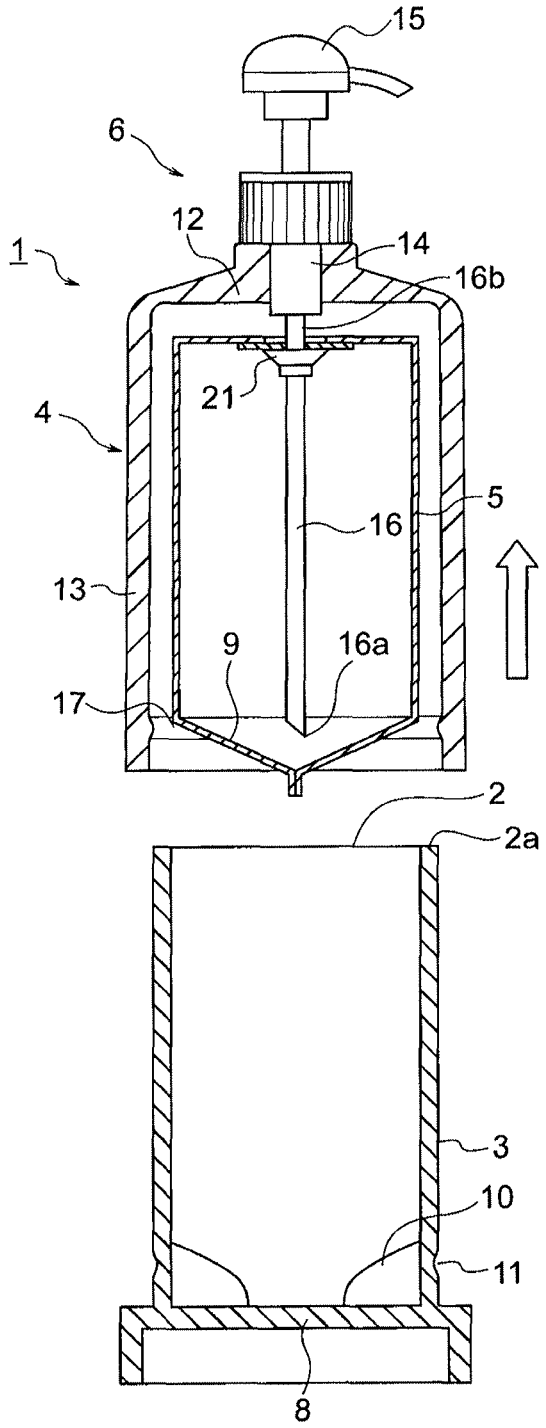
FIG. 6 is a sectional view for illustrating a step of taking the inner container out of the outer container of the refillable container illustrated in FIG. 1.

FIG. 1 is an exploded sectional view for illustrating the refillable container according to one embodiment of the present invention. FIG. 2 is a sectional view for illustrating a step of accommodating an inner container in an outer container of the refillable container illustrated in FIG. 1. FIG. 3 is a sectional view for illustrating a step of accommodating the inner container in the outer container of the refillable container illustrated in FIG. 1. FIG. 4 is a sectional view for illustrating a complete state of accommodation of the inner container in the outer container of the refillable container illustrated in FIG. 1. FIG. 5 is a sectional view for illustrating a step of taking the inner container out of the outer container of the refillable container illustrated in FIG. 1. FIG. 6 is a sectional view for illustrating a step of taking the inner container out of the outer container of the refillable container illustrated in FIG. 1.

A refillable container 1 in this embodiment includes an outer container 3, a cover 4, an inner container 5, and a dispense pump 6. The outer container 3 has an opening 2 formed in a top of the outer container 3, and is made of plastic. The cover 4 is configured to close the opening 2 of the outer container 3, and is made of plastic. The inner container 5 is configured to store a liquid content such as a shampoo and a liquid soap therein, and is replaceably accommodated in the outer container 3 when the liquid content is used up. The inner container 5 is made of paper. The dispense pump 6 is provided to the cover 4, and is configured to pump up the liquid content in the inner container 5 accommodated in the outer container 3 and to dispense the liquid content to an outside.

In this embodiment, the outer container 3 is made of transparent plastic. However, its material is not limited to be transparent. Further, in this embodiment, a body of the outer container 3 is formed into a tubular shape having a substantially square cross section. A length of the outer container 3 is set so that an end surface 2*a* of the opening 2 of the outer container 3 is flush with an upper surface 7 of the inner container 5 or slightly higher than the upper surface 7 of the inner container 5 when the inner container 5 is accommodated in the outer container 3. In this embodiment, the outer container 3 is formed to have such a length that the end surface 2*a* of the opening 2 of the outer container 3 is slightly higher than the upper surface 7 of the inner container 5.

Further, a bottom receiving portion 10 is formed on a bottom 8 in the outer container 3. The bottom receiving portion 10 is configured to receive a bottom 9 of the inner container 5 accommodated in the outer container 3.

Further, a concave stripe 11 is formed in an outer peripheral surface of the outer container 3 along a circumferential direction. Through use of elastic deformation, the concave stripe 11 is engaged with and disengaged from a convex stripe formed on an inner peripheral surface of a tubular wall portion of the cover 4 to be described later.

Further, the cover 4 includes a top plate portion 12 configured to close the opening 2 of the outer container 3, and a tubular wall portion 13 to be fitted to an outer periphery of the outer container 3.

The dispense pump 6 provided to the cover 4 includes a tubular cylinder portion 14, a dispense nozzle 15, and a suction tube 16. The dispense nozzle 15 is provided to an upper part of the tubular cylinder portion 14, and serves also as an operation portion for a piston that is slidably fitted into the tubular cylinder portion 14. The suction tube 16 is provided to a lower part of the tubular cylinder portion 14. The tubular cylinder portion 14 penetrates the top plate portion 12 of the cover 4, and is fixed to the ceiling plate portion 12. The dispense nozzle 15 is arranged on the top surface side of the ceiling plate portion 12. The suction tube 16 is arranged on the bottom surface side of the top plate portion 12.

When the opening 2 of the outer container 3 is closed by fitting the tubular wall portion 13 of the cover 4 to the outer periphery of the outer container 3, the suction tube 16 arranged below the top plate portion 12 of the cover 4 is inserted into the inner container 5 accommodated in the outer container 3. The suction tube 16 arranged below the top plate portion 12 of the cover 4 has such a length that a distal end 16*a* of the suction tube 16 is positioned within an open end 13*a* of the tubular wall portion 13.

In this embodiment, in addition, the suction tube 16 has such a length that the distal end 16*a* is positioned at a vicinity of the bottom 9 of the inner container 5 when the suction tube 16 is inserted into the inner container 5 accommodated in the outer container 3 by fitting the tubular wall portion 13 of the cover 4 to the outer periphery of the outer container 3 to close the opening 2 of the outer container 3.

Further, a convex stripe 17 is formed on the inner peripheral surface of the tubular wall portion 13 of the cover 4 along the circumferential direction. When the opening 2 of the outer container 3 is closed by the cover 4, through use of elastic deformation, the convex stripe 17 is engaged with and disengaged from the concave stripe 11 formed in the outer peripheral surface of the outer container 3.

In this embodiment, the convex stripe 17 is formed on the inner peripheral surface of the tubular wall portion 13 of the cover 4, and the concave stripe 11 is formed in the outer peripheral surface of the outer container 3. However, a concave stripe may be formed in the inner peripheral surface of the tubular wall portion 13 of the cover 4, and a convex stripe may be formed on the outer peripheral surface of the outer container 3.

Further, the inner container 5 is formed of a paper container material having a thermoplastic resin layer at least on an inner surface of a paper base, and a suction port 18 is formed in the upper surface 7 of the inner container 5. In this embodiment, as for the suction port 18, a hole 19 being the suction port 18 is formed in the upper surface 7 of the inner container 5. A tearable film 20 is provided on a back surface of the upper surface 7 so as to seal the hole 19. A suction tube 16 of the dispense pump 6 is stuck into the film 20 so as to tear the film 20.

The hole 19 being the suction port 18 has a diameter larger than a diameter of the suction tube 16 of the dispense pump 6. It is preferred that the diameter of the hole 19 be larger than the diameter of the suction tube 16 of the dispense pump 6 by at least 2 mm or more. In this embodiment, the film 20 configured to seal the hole 19 is provided to the back surface of the upper surface 7, but not limited thereto. The film 20 may be provided to the front surface of the upper surface 7, or both of the front and back surfaces of the upper surface.

A known film, such as polyethylene, polypropylene, polyester, or cellophane may be used as the film 20, but not particularly limited thereto. When the film 20 is a thermoplastic resin, the hole formed in the upper surface 7 can be easily sealed by heat sealing.

In addition, aluminum foil, paper, or the like may be laminated on the film 20 in order to improve tearability, light-blocking property, oxygen barrier property, or the like.

Further, the inner container 5 is positioned so as not to move in the outer container 3 and accommodated in the outer container 3. In this embodiment, a shape of a cross section of the inner container 5 is formed so as to be substantially similar to a shape of an inner cross section of the outer container 3. When the inner container 5 is accommodated in the outer container 3, an outer surface of the inner container 5 is supported by an inner surface of the outer container 3, and the bottom 9 of the inner container 5 is received by the bottom receiving portion 10 formed on the bottom 8 in the outer container 3. In this manner, the inner container 5 is positioned in the outer container 3.

The bottom 9 of the inner container 5 of this embodiment has an inverted gable roof shape. In this embodiment, the bottom 9 having the inverted gable roof shape is formed through procedures of forming an apex of a gable top shape.

Further, in this embodiment, a wedge-shaped collar portion 21 is provided on the suction tube 16 of the dispense pump 6. The collar portion 21 is formed to have a diameter equal to or slightly larger than the diameter of the hole 19 being the suction port 18 formed in the upper surface 7 of the inner container 5. When the opening 2 of the outer container 3 is closed by the cover 4, along with downward movement of the suction tube 16 of the dispense pump 6, the collar portion 21 is brought into abutment against the hole 19, and is elastically deformed so as to enter the inner container 5. When the cover 4 is disengaged from the outer container 3, along with upward movement of the suction tube 16 of the dispense pump 6, the collar portion 21 is caught by the hole 19, thereby being pulled up together with the inner container 5. More specifically, it is preferred that a diameter of the collar portion 21 be equal to the diameter of the hole 19, or larger than the diameter of the hole 19 within a range that does not exceed 1 mm. In a case in which the diameter of the collar portion 21 is smaller than the diameter of the hole 19, when the cover 4 is disengaged from the outer container 3, there is a fear in that the collar portion 21, which is moved upward along with upward movement of the suction tube 16 of the dispense pump 6, may slip through the hole 19, with the result that the inner container 5 may remain in the outer container 3. Further, in a case in which the diameter of the collar portion 21 is larger than the diameter of the hole 19 by more than 1 mm, it is difficult to disengage the inner container 5 from the suction tube 16.

A position of the suction tube 16 at which the wedge-shaped collar portion 21 is provided is not particularly limited except a distal end region of the suction tube 16. In this embodiment, the collar portion 21 is provided on a proximal end portion 16*b* of the suction tube 16.

Further, in this embodiment, the suction port 18 is formed in the upper surface 7 of the inner container 5 at a center of the upper surface 7, and the dispense pump 6 is provided on the cover 4 at a center of the top plate portion 12 of the cover 4.

In the refillable container 1 configured as described above, refilling work of the liquid content is performed as described below.

The refilling work of the liquid content in the refillable container 1 is classified into a work of accommodating the inner container 5 in the outer container 3 of the refillable container 1, and a work of taking the inner container 5 accommodated in the outer container 3 out of the outer container 3.

In the work of accommodating the inner container 5 in the outer container 3, first, the inner container 5 is accommodated in the outer container 3.

When the inner container 5 is accommodated in the outer container 3, the outer surface of the inner container 5 is supported by the inner surface of the outer container 3, and the bottom 9 of the inner container 5 is received by the bottom receiving portion 10 formed on the bottom 8 of the outer container 3. In this manner, the inner container 5 is positioned in the outer container 3.

Next, the tubular wall portion 13 of the cover 4 is fitted to the outer periphery of the outer container 3 that accommodates the inner container 5 therein. The suction tube 16 of the dispense pump 6 arranged below the top plate portion 12 of the cover 4 has such a length that the distal end 16*a* of the suction tube 16 is positioned within the open end 13*a* of the tubular wall portion 13. With this configuration, in an initial stage of fitting the tubular wall portion 13 of the cover 4 to the outer periphery of the outer container 3, the distal end of the suction tube 16 does not reach the suction port 18 formed in the upper surface 7 of the inner container 5.

Further, in this embodiment, the suction port 18 is formed in the upper surface 7 of the inner container 5 at the center of the upper surface 7, and the dispense pump 6 is provided on the cover 4 at the center of the top plate portion 12 of the cover 4. With this configuration, when the tubular wall portion 13 of the cover 4 is fitted to the outer periphery of the outer container 3, the suction tube 16 of the dispense pump 6 provided on the cover 4 is regulated so as to be positioned above the suction port 18 formed in the upper surface 7 of the inner container 5 accommodated in the outer container 3 (see FIG. 2).

When the cover 4 fitted to the outer periphery of the outer container 3 is pushed forward along the outer periphery of the outer container, the cover 4 is moved straight while being guided by the outer container 3. Further, the distal end 16*a* of the suction tube 16 of the dispense pump 6 provided on the cover 4 is automatically guided into the suction port 18 formed in the upper surface 7 of the inner container 5 accommodated in the outer container 3, and thus is stuck and inserted into the suction port 18. In this manner, the suction tube 16 is inserted into the inner container 5 (see FIG. 3).

When the cover 4 fitted to the outer periphery of the outer container 3 is further pushed forward along the outer periphery of the outer container, the opening 2 of the outer container 3 is closed by the cover 4. When the opening 2 of the outer container 3 is closed by the cover 4, at this position, the convex stripe 17 formed on the inner peripheral surface of the tubular wall portion 13 of the cover 4 is elastically deformed so as to be engaged with the concave stripe 11 formed in the outer peripheral surface of the outer container 3.

In this embodiment, the wedge-shaped collar portion 21 is provided on the suction tube 16 of the dispense pump 6. During fitting of the cover 4, the collar portion 21 is brought into abutment against the hole 19 being the suction port 18 formed in the upper surface 7 of the inner container 5, and is elastically deformed so as to enter the inner container 5.

When the opening 2 of the outer container 3 is closed by the cover 4, in this embodiment, the distal end 16*a* of the suction tube 16 inserted into the inner container 5 is positioned at the vicinity of the bottom 9 of the inner container 5 (see FIG. 4).

Thus, the work of accommodating the inner container 5 in the outer container 3 is completed.

After the liquid content in the inner container 5 accommodated in the outer container 3 is used up, the cover 4 is disengaged from the outer container 3, and the inner container 5 in which the liquid content is used up is taken out of the outer container 3.

When performing the work of taking the inner container 5 accommodated in the outer container 3 out of the outer container 3, the cover 4 fitted to the outer container 3 is pulled up. When the cover 4 is pulled up, the convex stripe 17 formed on the inner peripheral surface of the tubular wall portion 13 of the cover 4 is elastically deformed and disengaged from the concave stripe 11 formed in the outer peripheral surface of the outer container 3, thereby enabling the cover 4 to be pulled up.

Further, when the cover 4 is pulled up, the wedge-shaped collar portion 21 provided on the suction tube 16 of the dispense pump 6 is caught in the hole 19 being the suction port 18 formed in the upper surface 7 of the inner container 5. Thus, the inner container 5 is pulled up together with the cover 4 (see FIG. 5).

In addition, when pulling up of the cover 4 is continued and the tubular wall portion 13 of the cover 4 is disengaged from the outer container 3, the cover 4 is disengaged from the outer container 3. At the same time, the inner container 5 is pulled out of the outer container 3 (see FIG. 6).

In this manner, the work of taking the inner container 5 accommodated in the outer container 3 out of the outer container 3 is completed.

REFERENCE SIGNS LIST

1 refillable container
2 opening
3 outer container
4 cover
5 inner container
6 dispense pump
7 upper surface
8, 9 bottom
10 bottom receiving portion
11 concave stripe
12 top plate portion
13 tubular wall portion
13*a* open end
14 tubular cylinder portion
15 dispense nozzle
16 suction tube
16*a* distal end
16*b* proximal end portion
17 convex stripe
18 suction port
19 hole
20 film
21 collar portion

The invention claimed is:

1. A refillable container, comprising:

an outer container, which has an opening formed on top thereof, and is made of plastic;

a cover, which is configured to close the opening of the outer container, and is made of plastic;

an inner container, which is made of paper, configured to store a liquid content therein, and is accommodated in the outer container so as to be replaceable when the liquid content is used up, the inner container having a hole formed in an upper surface thereof, and having a suction port formed by sealing the hole with a tearable film; and a dispense pump, which is provided on the cover, and is configured to pump up and dispense the liquid content with a suction tube to an outside of the refillable container under a state in which the suction tube is stuck into the suction port of the inner container accommodated in the outer container, the suction tube of the dispense pump being inserted into the suction port of the inner container when the opening of the outer container is closed by the cover, wherein the suction tube of the dispense pump has a diameter smaller than a diameter of the hole that forms the suction port of the inner container, wherein the suction tube includes a collar portion having a wedge shape and a diameter equal to or slightly larger than the diameter of the hole, wherein, when the opening of the outer container is closed by the cover, along with downward movement of the suction tube of the dispense pump, the collar portion is brought into abutment against the hole, and is elastically deformed so as to enter the inner container, and wherein, when the cover is disengaged from the outer container, along with upward movement of the suction tube of the dispense pump, the collar portion is caught by the hole, thereby being pulled up together with the inner container.

2. A refillable container according to claim 1, wherein the suction tube of the dispense pump has such a length that the distal end of the suction tube is positioned at a vicinity of a bottom of the inner container when the opening of the outer container is closed by the cover.

3. A refillable container according to claim 1, wherein one of the cover and the outer container has one of a convex stripe and a concave stripe, which are formed along a circumferential direction on one of an inner peripheral surface of the tubular wall portion of the cover and an outer peripheral surface of the outer container, and are engaged in a disengageable manner with each other when the opening of the outer container is closed by the cover.

4. A refillable container according to claim 1, wherein the suction port of the upper surface of the inner container is formed at a center of the upper surface of the inner container, and wherein the dispense pump provided on the cover is provided at a center of a top plate portion of the cover.

5. A refillable container according to claim 1, wherein the cover includes a tubular wall portion to be fitted to an outer periphery of the outer container, and wherein the suction tube of the dispense pump has such a length that a distal end of the suction tube is positioned within an open end of the tubular wall portion.

* * * * *